US010801332B2

(12) United States Patent
Kang et al.

(10) Patent No.: US 10,801,332 B2
(45) Date of Patent: Oct. 13, 2020

(54) CORE FOR CASTING TURBINE BLADE, METHOD OF MANUFACTURING THE CORE, AND TURBINE BLADE MANUFACTURED USING THE CORE

(71) Applicant: HANWHA AEROSPACE CO., LTD, Changwon-si (KR)

(72) Inventors: Sung Jin Kang, Changwon-si (KR); Chang Geun Kim, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 165 days.

(21) Appl. No.: 15/600,022

(22) Filed: May 19, 2017

(65) Prior Publication Data

US 2017/0335694 A1 Nov. 23, 2017

(30) Foreign Application Priority Data

May 20, 2016 (KR) ..... 10-2016-0062175

(51) Int. Cl.
*B22C 9/10* (2006.01)
*F01D 5/18* (2006.01)

(52) U.S. Cl.
CPC ..... *F01D 5/187* (2013.01); *F05D 2230/211* (2013.01); *F05D 2250/185* (2013.01)

(58) Field of Classification Search
CPC ..... B22C 9/10; B22C 9/103; B22C 9/108
USPC ..... 164/369
See application file for complete search history.

(56) References Cited

U.S. PATENT DOCUMENTS 6,062,817 A * 5/2000 Danowski et al. ..... B22C 9/103 416/229 A
2004/0112564 A1* 6/2004 Devine, II et al. ..... B22C 9/04 164/369
2007/0131382 A1* 6/2007 Otero et al. ..... B22C 9/04 164/516
2008/0145234 A1 6/2008 Lee et al.
2012/0230838 A1 9/2012 Hada
(Continued)

FOREIGN PATENT DOCUMENTS

KR 10-1317443 B1 10/2013
KR 10-1380628 B1 4/2014
KR 10-1438218 B1 9/2014
(Continued)

*Primary Examiner* — Kevin P Kerns
(74) *Attorney, Agent, or Firm* — Sughrue Mion, PLLC

(57) ABSTRACT

A core for casting a turbine blade to form at least one cooling passage in a wing portion of the turbine blade, wherein the wing portion includes a leading edge region and a trailing edge region, and has a streamlined cross-section, the core including: at least one of a first core unit having a shape corresponding to a cooling passage located at the leading edge region and a second core unit spaced apart from the first core unit and having a shape corresponding to a cooling passage located at the trailing edge region, wherein each of the first core unit and the second core unit includes: a plurality of extending portions extending in a longitudinal direction and located substantially parallel to one another; at least one curved portion connecting adjacent ends of the plurality of extending portions; and at least one through-portion located between the plurality of extending portions and having an empty space extending in a width direction of the wing portion.

13 Claims, 5 Drawing Sheets

(56) References Cited

U.S. PATENT DOCUMENTS

| | | | | |
|---|---|---|---|---|
| 2015/0184518 | A1* | 7/2015 | Lee | F01D 5/186<br>416/97 R |
| 2016/0003055 | A1* | 1/2016 | Ghigliotty et al. | F01D 5/187<br>416/95 |

FOREIGN PATENT DOCUMENTS

| | | | |
|---|---|---|---|
| KR | 10-2015-0082944 | A | 7/2015 |
| KR | 10-1552450 | B1 | 9/2015 |

* cited by examiner

CORE FOR CASTING TURBINE BLADE, METHOD OF MANUFACTURING THE CORE, AND TURBINE BLADE MANUFACTURED USING THE CORE

CROSS-REFERENCE TO THE RELATED APPLICATION

This application claims priority from Korean Patent Application No. 10-2016-0062175, filed on May 20, 2016, in the Korean Intellectual Property Office, the disclosure of which is incorporated herein in its entirety by reference.

BACKGROUND

1. Field

Apparatuses and methods consistent with exemplary embodiments of the inventive concept relate to a core for casting a turbine blade, a method of manufacturing the core, and a turbine blade using the core, and more particularly, to a core for casting a turbine blade to form a cooling passage in the turbine blade, a method of manufacturing the core, and a turbine blade manufactured using the core.

2. Description of the Related Art

A gas turbine is an apparatus which compresses air by using a compressor, combusts fuel, heats the compressed air, and expands air through a turbine, to produce power. A gas turbine includes a turbine blade that contacts a combustion gas, and the turbine blade has to be efficiently cooled because a temperature of the combustion gas increases as output power of the gas turbine increases.

In general, a turbine blade is cooled when cooling air extracted and compressed by a compressor of a gas turbine flows through a passage in the turbine blade. Casting is one of the methods that may be used to form a cooling passage in a turbine blade. In detail, a turbine blade is casted in a state in which a core having the same shape as that of a cooling passage is located in a cavity of a mold. The core having the same shape as that of the cooling passage may also be manufactured by using casting.

SUMMARY

A conventional core for casting a turbine blade and a method of manufacturing the conventional core may have problems in that a core may be broken or deformed in a process of separating the core from a mold for casting the core due to a shape complexity.

The exemplary embodiments of the inventive concept provide a core for casting a turbine blade that may prevent damage to the core in a process of manufacturing the core, a method of manufacturing the core, and a turbine blade manufactured using the core.

Various aspects of the inventive concept will be set forth in part in the description which follows and, in part, will be apparent from the description, or may be learned by practice of the presented embodiments.

According to one or more exemplary embodiments, there is provided a core for casting a turbine blade to form a cooling passage in a wing portion of the turbine blade, wherein the wing portion includes a leading edge region and a trailing edge region, and has a streamlined cross-section. The core may include: at least one of a first core unit having a shape corresponding to a cooling passage located at the leading edge region, and a second core unit spaced apart from the first core unit and having a shape corresponding to a cooling passage located at the trailing edge region, wherein each of the first core unit and the second core unit includes: a plurality of extending portions extending in a longitudinal direction and located substantially parallel to one another; at least one curved portion connecting adjacent ends of the plurality of extending portions; and at least one through-portion located between the plurality of extending portions and having an empty space extending in a width direction of the wing portion.

The core may further include: a third core unit located adjacent to a trailing edge of the second core unit and having a plurality of holes and a plurality of slots; and an additional through-portion located between the second core unit and the third core unit and having an empty space extending in the width direction of the wing portion.

The third core unit may be connected to the trailing edge of the second core unit.

The plurality of extending portions may include a first extending portion and a second extending portion located on a leading edge of the first core unit, wherein the first core unit includes a plurality of connecting portions configured to connect the first extending portion with the second extending portion.

The at least one through-portion of the first core unit and the at least one through-portion of the second core unit may be parallel to each other.

The first core unit may include a plurality of through-portions, wherein at least two from among the plurality of through-portions of the first core unit are substantially parallel to each other.

The second core unit may include a plurality of through-portions, and at least two of the plurality of through-portions of the second core unit are substantially parallel to each other.

The core may further include: a third core unit located adjacent to a trailing edge of the second core unit and having a plurality of holes and a plurality of slots; and an additional through-portion located between the second core unit and the third core unit and having an empty space extending in the width direction of the wing portion, wherein the additional through-portion is located substantially parallel to the at least one through-portion of the first core unit.

The core may further include: a third core unit located adjacent to a trailing edge of the second core unit and having a plurality of holes and a plurality of slots; and an additional through-portion located between the second core unit and the third core unit and having an empty space extending in the width direction of the wing portion, wherein the additional through-portion is located substantially parallel to the at least one through-portion of the second core unit.

The plurality of extending portions and the at least one curved portion may be connected to one another to form an S-shape.

According to one or more exemplary embodiments, there is provided a method of manufacturing a core for casting a turbine blade to form a cooling passage in a wing portion of the turbine blade, wherein the wing portion includes a leading edge region and a trailing edge region, and has a streamlined cross-section. The method may include: forming the core by injecting a core forming material into a cavity of a mold; and separating the core from the mold, wherein the separating of the core includes separating the mold in the width direction of the wing portion.

According to one or more exemplary embodiments, there is provided a turbine blade which may include: a wing portion including a leading edge region and a trailing edge region and having a streamlined cross-section; and a cooling passage located in the wing portion and having a shape corresponding to the above core.

According to one or more exemplary embodiments, there is provided a turbine blade which may include: a wing portion including a plurality of cooling passages connected to each other, and configured to pass air introduced to at least one of the cooling passages; and a support portion including at least one inlet configured to introduce the air to the at least one cooling passage. The wing portion may further include at least one outlet configured to discharge the air, and one of the cooling passages, which is disposed closest to a leading edge of the wing portion, and an adjacent cooling passage may be connected to each other through a plurality of intermediate passages such that the air discharged from the adjacent cooling passage collides with the leading edge of the wing portion. One of the cooling passages, which is disposed closest to a trailing edge of the wing portion, may include a plurality of partition walls, to which the air collides, and a plurality of outlets through which the air is discharged.

BRIEF DESCRIPTION OF THE DRAWINGS

These and/or other aspects will become apparent and more readily appreciated from the following description of the exemplary embodiments, taken in conjunction with the accompanying drawings, in which.

DETAILED DESCRIPTION

Figure 1:
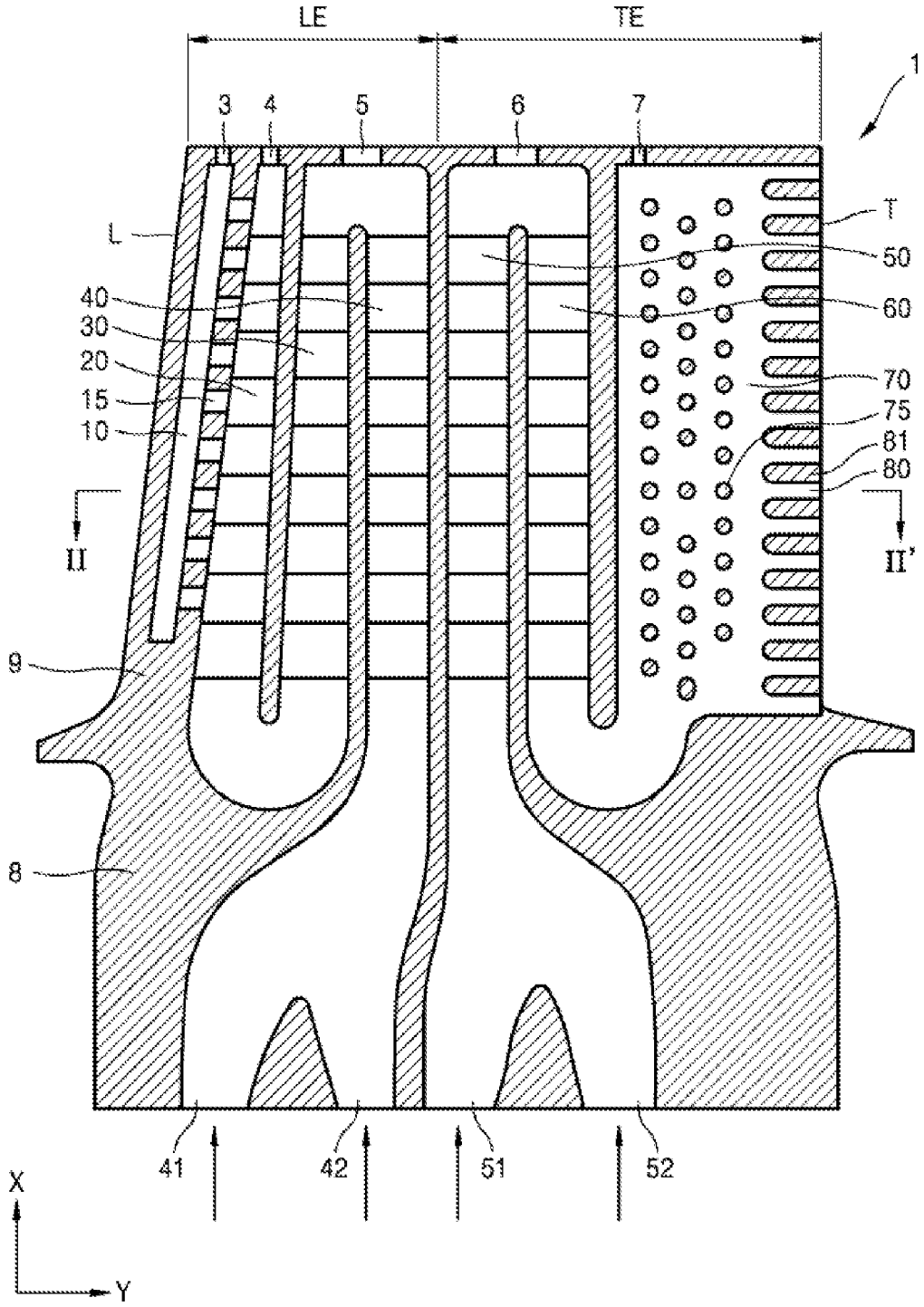
FIG. 1 is a cross-sectional view of a turbine blade according to an exemplary embodiment.

As the inventive concept allows for various changes and numerous embodiments, exemplary embodiments will be illustrated in the drawings and described in detail in the written description. However, this is not intended to limit the inventive concept to particular modes of practice, and it is to be appreciated that all changes, equivalents, and substitutes that do not depart from the spirit and technical scope of the inventive concept are encompassed in the inventive concept. In the description of the exemplary embodiments, certain detailed explanations of the related art are omitted when it is deemed that they may unnecessarily obscure the essence of the inventive concept.

It will be understood that although the terms "first", "second", etc. may be used herein to describe various elements, these elements should not be limited by these terms. These elements are only used to distinguish one element from another.

It will be understood that when a layer, film, region, or plate is referred to as being "formed on", another layer, film, region, or plate, it can be directly or indirectly formed on the other layer, film, region, or plate. That is, for example, intervening layers, films, regions, or plates may be present.

In the following examples, the x-axis, the y-axis, and the z-axis are not limited to three axes of the rectangular coordinate system, and may be interpreted in a broader sense. For example, the x-axis, the y-axis, and the z-axis may be perpendicular to one another, or may represent different directions that are not perpendicular to one another.

The exemplary embodiments will now be described more fully with reference to the accompanying drawings. In the drawings, the same elements are denoted by the same reference numerals and a repeated explanation thereof will not be given. In the drawings, the sizes and relative sizes of layers and regions are exaggerated for clarity and convenience of explanation.

Expressions such as "at least one of," when preceding a list of elements, modify the entire list of elements and do not modify the individual elements of the list.

Figure 2:
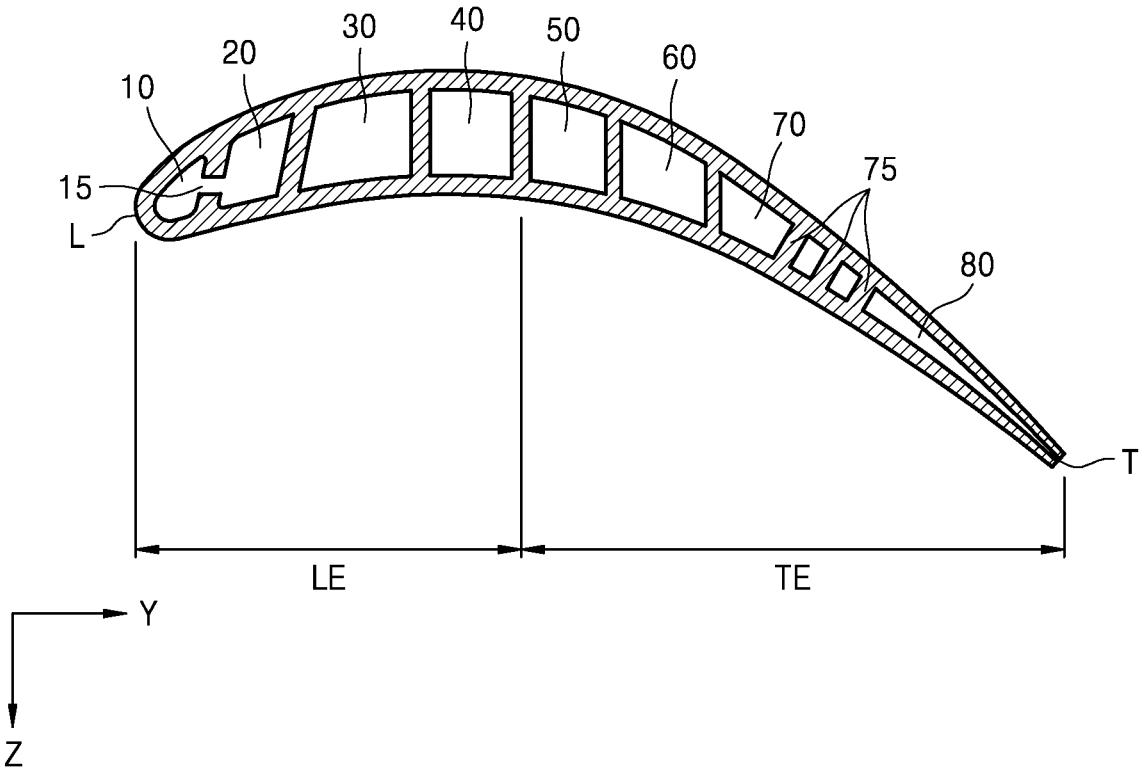
FIG. 2 is a cross-sectional view taken along line II-II' of FIG. 1, according to an exemplary embodiment.

FIG. 1 is a cross-sectional view of a turbine blade 1 according to an exemplary embodiment. FIG. 2 is a cross-sectional view taken along line II-II' of FIG. 1, according to an exemplary embodiment.

Referring to FIGS. 1 and 2, the turbine blade 1 according to an exemplary embodiment includes a wing portion 9 and cooling passages, e.g., first through seventh cooling passages 10, 20, 30, 40, 50, 60 and 70, located in the wing portion 9. The first through seventh cooling passages 10, 20, 30, 40, 50, 60 and 70 have a shape corresponding to a core for casting the turbine blade 1 which will be described below. The turbine blade 1 may further include a support portion 8 that supports the wing portion 9.

A bottom surface of the wing portion 9 is connected to the support portion 8, and the wing portion 9 extends in a +Y direction or a −Y direction away from the support portion 8. The support portion 8 may support the wing portion 9, and may connect the turbine blade 1 to a main body of a blade assembly (not shown). The support portion 8 includes inlets 41, 42, 51 and 52 through which external compressed air is introduced.

The wing portion 9 generates a rotational force by contacting a high-temperature combustion gas of a gas turbine. The wing portion 9 has a streamlined cross-section, and includes a leading edge region LE that is located at the upstream side of the flow of compressed air and first contacts a high-temperature gas, and a trailing edge region TE extending from the leading edge region LE and located at the downstream side of the flow of the high-temperature gas.

The first through seventh cooling passages 10, 20, 30, 40, 50, 60, and 70 through which compressed air passes are located in the wing portion 9 to uniformly cool the turbine blade 1. The first through seventh cooling passages 10, 20, 30, 40, 50, 60, and 70 formed in the wing portion 9 may have a serpentine shape.

Although the first through seventh cooling passages 10, 20, 30, 40, 50, 60 and 70 are divided into passages located in the leading edge region LE and passages located in the trailing edge region TE in FIG. 1, the inventive concept is not limited thereto, and the number of the cooling passages may vary according to a size or the like of the wing portion 9.

In the leading edge region LE of the wing portion 9, the first cooling passage 10, the second cooling passage 20, the third cooling passage 30, and the fourth cooling passage 40 may be sequentially arranged away from the trailing edge region TE. The first cooling passage 10, the second cooling passage 20, the third cooling passage 30, and the fourth cooling passage 40 allow air introduced from the inlets 41 and 42 located at a lower portion of the leading edge region LE from among the inlets 41, 42, 51 and 52 of the support portion 8 to pass therethrough. The air first moves through the fourth cooling passage 40 to the third cooling passage 30. In this process, a portion of the air is discharged to an outlet 5 located between the fourth cooling passage 40 and the third cooling passage 30. Next, air passing through the third cooling passage 30 moves through the second cooling passage 20, and a portion of the air is discharged to an outlet 4 connected to an upper end of the second cooling passage 20.

A portion of air passing through the second cooling passage 20 moves through an intermediate passage 15 to the first cooling passage 10, and is discharged to an outlet 3 connected to an upper end of the first cooling passage 10. In this case, air introduced into the first cooling passage 10 through the intermediate passage 15 strongly collides with a leading edge L of the wing portion 9. Due to the collision of the air, the leading edge L that first contacts the high-temperature gas may be effectively cooled.

In the trailing edge region TE of the wing portion 9, the fifth cooling passage 50, the sixth cooling passage 60, and the seventh cooling passage 70 may be sequentially arranged away from the leading edge region LE. The fifth cooling passage 50, the sixth cooling passage 60, and the seventh cooling passage 70 allow air introduced from the inlets 51 and 52 located at a lower portion of the trailing edge region TE from among the inlets 41, 42, 51 and 52 of the support portion 8 to pass therethrough. The air first moves through the fifth cooling passage 50 to the sixth cooling passage 60. In this process, a portion of the air is discharged to an outlet 6 located between the fifth cooling passage 50 and the sixth cooling passage 60. Next, air passing through the sixth cooling passage 60 moves through the seventh cooling passage 70, and a portion of the air is discharged to an outlet 7 connected to an upper end of the seventh cooling passage 70, and the rest of the air is discharged to the outside through the eighth cooling passage 80.

In this case, a plurality of partition walls 75 are formed in the seventh cooling passage 70. As air passes between the plurality of partition walls 75, a contact area between the air and the seventh cooling passage 70 increases. Accordingly, a cooling effect of the wing portion 9 due to the air may be further improved.

Also, since the eighth cooling passage 80 extends from the seventh cooling passage 70 up to a trailing edge T of the wing portion 9, air in the wing portion 9 may be discharged in a direction corresponding to the flow of a gas formed outside the trailing edge T. Accordingly, aerodynamic loss of the turbine blade 1 may be minimized.

Regarding a mid-section of the leading edge region LE of FIG. 2, in the first cooling passage 10, the flow of air may be formed in an outward direction from the drawing, and in the intermediate passage 15, the flow of air may be formed in a direction (e.g., the −Y direction) from the second cooling passage 20 to the first cooling passage 10. Also, in the second cooling passage 20, the flow of air may be formed in an outward direction from the drawing; in the third cooling passage 30, the flow of air may be formed in an inward direction to the drawing; and in the fourth cooling passage 40, the flow of air may be formed in an outward direction from the drawing.

Regarding a mid-section of the trailing edge region TE of FIG. 2, in the fifth cooling passage 50, the flow of air may be formed in an outward direction from the drawing, and in the sixth cooling passage 60, the flow of air may be formed in an inward direction to the drawing. Also, in the seventh cooling passage 70, the flow of air may be formed in an outward direction from the drawing, and a portion of the air may move in an outward direction from the drawing through a space between the partition walls 75. In the eighth cooling passage 80, the flow of air may be streamlined toward the trailing edge T of the wing portion 9.

Figure 3:
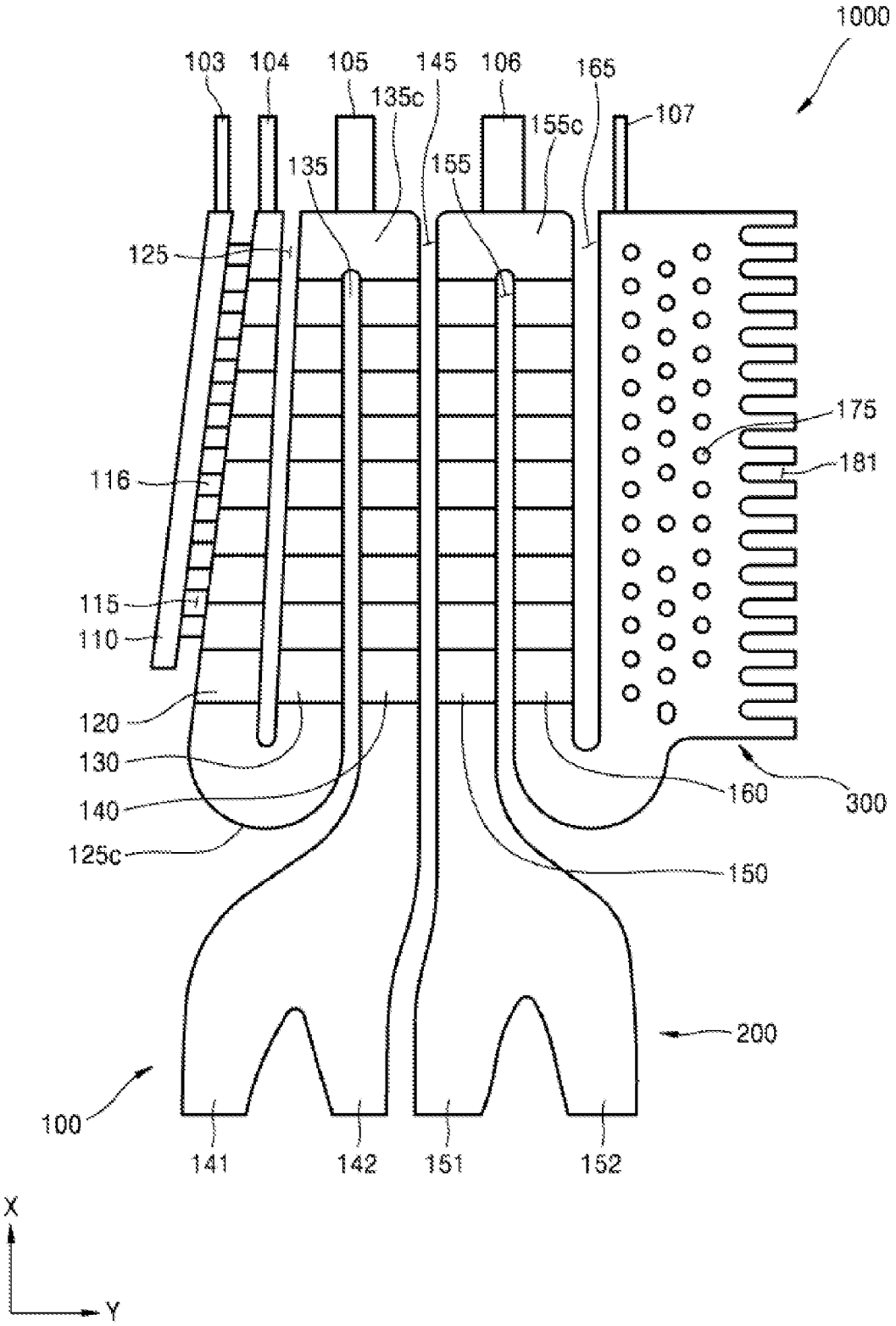
FIG. 3 is a cross-sectional view of a core for casting a turbine blade, according to an exemplary embodiment.
Figure 4:
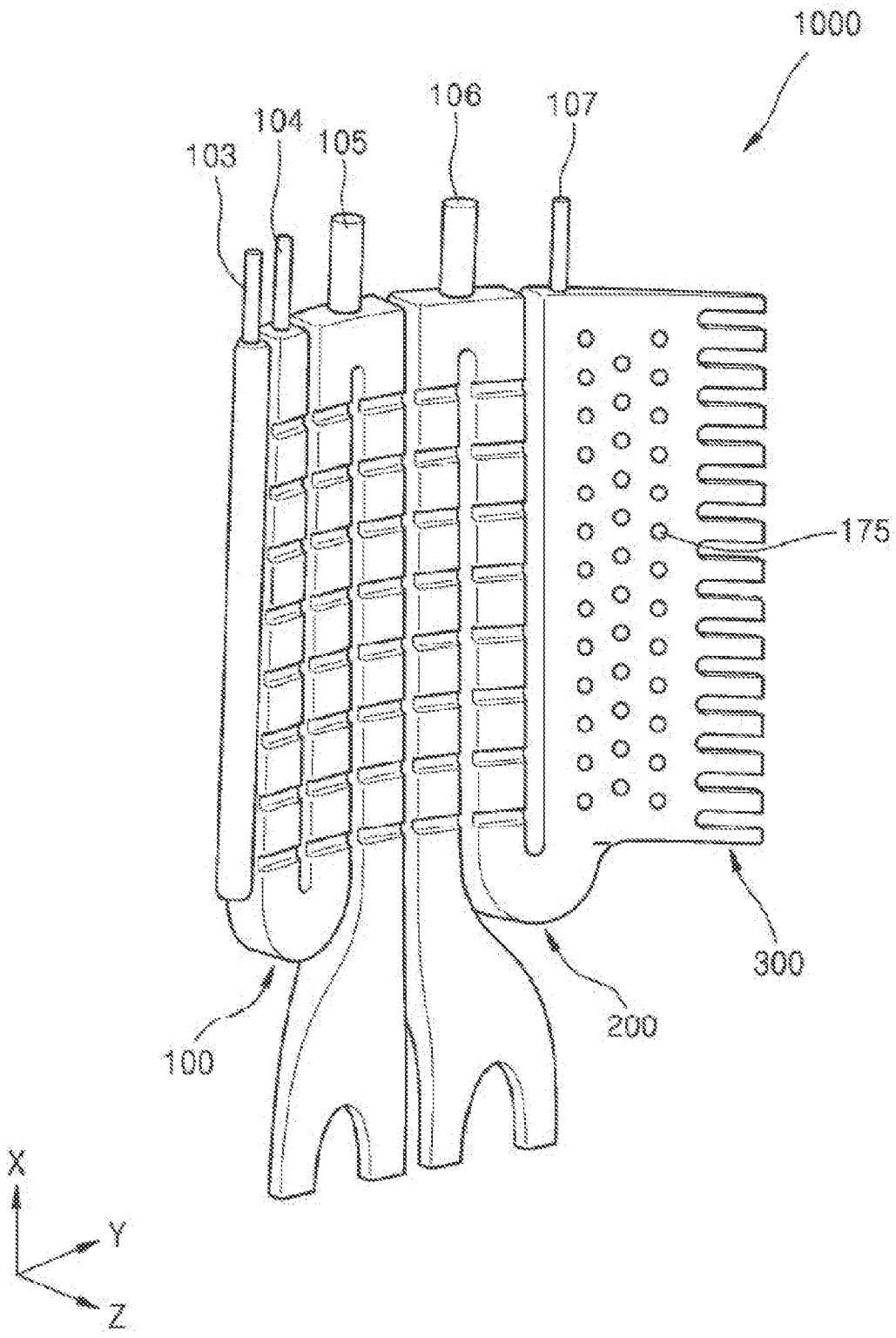
FIG. 4 is a perspective view of the core of FIG. 3, according to an exemplary embodiment.
Figure 5:
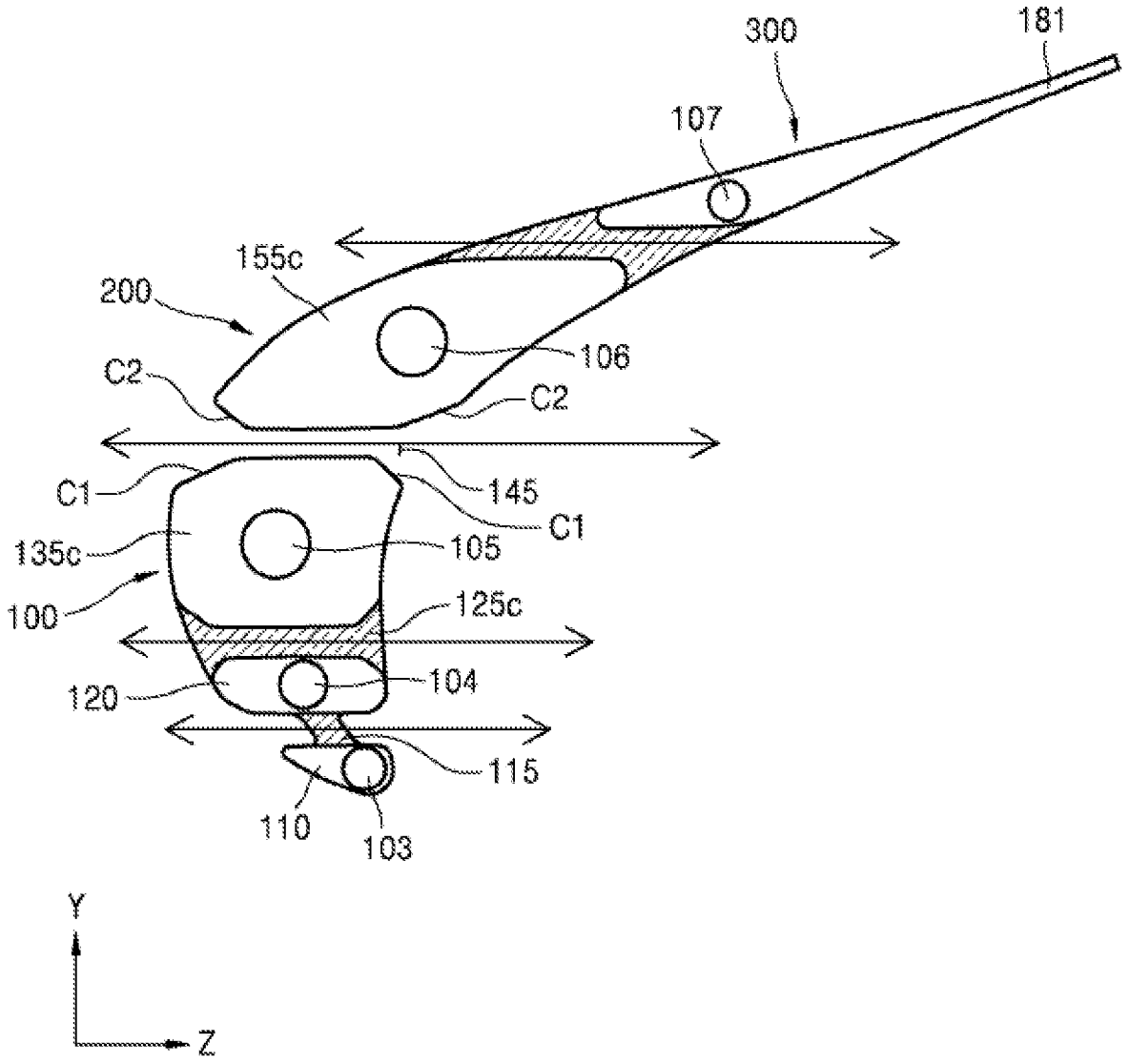
FIG. 5 is a plan view of the core of FIG. 3, according to an exemplary embodiment.

FIG. 3 is a cross-sectional view of a core 1000 for casting a turbine blade according to an exemplary embodiment. FIG. 4 is a perspective view of the core 1000 according to an exemplary embodiment. FIG. 5 is a plan view of the core 1000 according to an exemplary embodiment.

Referring to FIGS. 3 and 4, the core 1000 according to an exemplary embodiment includes at least one of a plurality of core units such as a first core unit 100 and a second core unit 200. Also, the core 1000 may further include a third core unit 300 connected to a trailing edge of the second core unit 200. For convenience of explanation, the following will be explained on an assumption that the core 1000 includes the first core unit 100, the second core unit 200, and the third core unit 300.

The first core unit 100 has a shape corresponding to a cooling passage located in the leading edge region LE of FIGS. 1 and 2. The second core unit 200 has a shape corresponding to a cooling passage located in the trailing edge TE of FIGS. 1 and 2.

In the first core unit 100, a plurality of extending portions are arranged substantially in parallel. For example, the plurality of extending portions may include a first extending portion 110, a second extending portion 120, a third extending portion 130, and a fourth extending portion 140. In this case, the first extending portion 110 has a shape corresponding to the first cooling passage 10, and likewise, the second extending portion 120, the third extending portion 130, and the fourth extending portion 140 have shapes respectively corresponding to the second cooling passage 20, the third cooling passage 30, and the fourth cooling passage 40. The number of the extending portions is not limited thereto, and may vary according to a size and a shape of the wing portion 9 of the turbine blade 1.

Each of the first through fourth extending portions 110, 120, 130 and 140 may extend in a longitudinal direction, for example, an X direction. Each of the first through fourth extending portions 110, 120, 130 and 140 may have any of various pillar shapes such as a square pillar shape or a cylindrical shape.

At least two extending portions from among the first through fourth extending portions 110, 120, 130 and 140 are connected to each other by a curved portion. In this case, the curved portion may connect adjacent ends of the extending portions, and thus, the extending portions may be connected without disconnection in the longitudinal direction. For example, as shown in FIG. 3, adjacent ends of the second extending portion 120 and the third extending portion 130 may be connected to each other by a first curved portion 125*c*, and adjacent ends of the third extending portion 130 and the fourth extending portion 140 may be connected to each other by a second curved portion 135*c*. Accordingly, the second through fourth extending portions 120, 130 and 140 from among the plurality of extending portions of the first core unit 100 are connected to one another such that they form an S-shape. That is, the second through fourth extending portions 120, 130 and 140 may be formed to have a serpentine shape, like cooling passages of the leading edge region LE of FIG. 1.

Also, portions 141, 142, 151 and 152 having shapes respectively corresponding to the inlets 41, 42, 51 and 52 of FIG. 1 are formed on a lower end of the core 1000.

A plurality of through-portions are located between the first through fourth extending portions 110, 120, 130 and 140. For example, the plurality of through-portions may include a first through-portion 115 located between the first extending portion 110 and the second extending portion 120, a second through-portion 125 located between the second extending portion 120 and the third extending portion 130, and a third through-portion 135 located between the third extending portion 130 and the fourth extending portion 140.

Each of the first through third through-portions 115 125, and 135 extends in a width direction (e.g., a Z direction) of the wing portion 9 of FIG. 1. In this case, the second and third through-portions 125 and 135 pass through the first core portion 100 in the Z direction to form an empty space.

In an exemplary embodiment, a plurality of first through-portions 115 may be arranged in the longitudinal direction (e.g., the X direction) of the first through fourth extending portions 110, 120, 130 and 140, and located between the first extending portion 110 and the second extending portion 120. Accordingly, a plurality of connecting portions 116 for connecting the first extending portion 110 with the second extending portion 120 may be formed between the first through-portions 115 that pass through the first core unit 100 in the Z direction. The connecting portions 116 have a shape corresponding to the intermediate passage 15 of FIGS. 1 and 2.

The second core unit 200 is spaced apart from the first core unit 100. Like the first core unit 100, the second core unit 200 may include a plurality of extending portions extending in the longitudinal direction and arranged substantially in parallel. For example, the plurality of extending portions may include a fifth extending portion 150 and a sixth extending portion 160. In this case, the fifth extending portion 150 and the sixth extending portion 160 may have shapes respectively corresponding to the fifth cooling passage 50 and the sixth cooling passage 60 of FIGS. 1 and 2.

The fifth and sixth extending portions 150 and 160 are connected to each other by at least one curved portion. In this case, the curved portion may connect adjacent ends of the fifth and sixth extending portions 150 and 160. Accordingly, at least two extending portions from among the plurality of extending portions may be connected without disconnection in the longitudinal direction. For example, as shown in FIG. 3, adjacent ends of the fifth extending portion 150 and the sixth extending portion 160 may be connected to each other by a third curved portion 155*c*. Accordingly, the fifth and sixth extending portions 150 and 160 of the second core unit 200 are connected to each other such that they form an S-shape.

At least one through-portion is located between the fifth and sixth extending portions 150 and 160. For example, the at least one through-portion may include a fifth through-portion 155 located between the fifth extending portion 150 and the sixth extending portion 160.

The third core unit 300 is connected to the trailing edge of the second core unit 200. The third core unit 300 has a plurality of holes 175 and a plurality of slots 181. In this case, the plurality of holes 175 have shapes respectively corresponding to the plurality of partition walls 75 of FIG. 1. Also, the plurality of slots 181 have shapes respectively corresponding to adjacent portions 81 of the eighth cooling passage 80 of FIG. 1.

Although the third core unit 300 is connected to the second core unit 200 in FIG. 3, the inventive concept is not limited thereto. That is, the third core unit 300 may be separate from the second core unit 200, and thus, like the first core unit 100 and the second core unit 200, the third core unit 300 and the second core unit 200 may be spaced apart from each other. Also, although the third core unit 300 is connected only to the trailing edge of the second core unit 200, the inventive concept is not limited thereto. An additional core unit (not shown) having a shape that is the same as or similar to that of the third core unit 300 may be connected to a leading edge of the first core unit.

An additional through-portion 165 is located between the third core unit 300 and the second core unit 200. Like the plurality of through-portions of the first core unit 100 and the second core unit 200, the additional through-portion 165 also extends in the width direction (e.g., the Z direction) of the wing portion 9 of FIG. 1. In this case, the additional through-portion 165 passes through the third core unit 300 in the Z direction to form an empty space.

As described above, the second through fourth through-portions 125, 135 and 145 of the first core unit 100, the fifth through-portion 155 of the second core unit 200, and the additional through-portion 165 located between the second core unit 200 and the third core unit 300 extend in the Z direction. For example, at least two through-portions from among the through-portions 125, 135, 145, 155 and 165 may be located substantially parallel to each other. When at least two elements are located substantially parallel to each other, it means that through-directions of at least two elements from among the through-portions 125, 135, 145, 155, and 165 are substantially parallel to each other.

A plurality of projections 103, 104, 105, 106 and 107 are formed on upper ends of the first core unit 100, the second core unit 200, and the third core unit 300. The plurality of projections 103, 104, 105, 106 and 107 have shapes respectively corresponding to the outlets 3, 4, 5, 6 and 7 of FIG. 1. As widths of the outlets 3, 4, 5, 6, and 7 vary according to a required cooling effect, widths of the plurality of projections 103, 104, 105, 106 and 107 vary in the same manner.

Also, at least two from among the plurality of projections 103, 104, 105, 106 and 107 may be connected to each other through an additional member (not shown). In this case, the additional member may function as a handle, and may improve work efficiency when the core 1000 is injected into a cavity of a mold for manufacturing the turbine blade 1.

As such, since the through-portions extend in substantially the same direction, the core 1000 may be prevented from being broken or deformed when the core 1000 is cast. That is, as shown in FIG. 5, since the core 1000 of FIGS. 3 and 4 is separated from a mold (not shown) for casting the core 1000 in the Z direction in which the through-portions extend, the core 1000 may be prevented from being broken or deformed in this separation process. In this case, in order to more easily separate the core 1000 from the mold, edges of the first through sixth extending portions 110, 120, 130, 140, 150 and 160 with the through-portions 115, 125, 135, 145, 155 and 165 therebetween may be chamfered. For example, the second curved portion 135*c*, the third curved portion 155*c*, and the fourth through-portion 145 located between the second curved portion 135*c* and the third curved portion 155*c* of FIG. 5 will be explained. The fourth through-portion 145 may extend in the Z direction, and edges C1 of the second curved portion 135*c* and edges C2 of the third curved portion 155*c* may be chamfered. The chamfered portions may extend in the X direction.

According to the above exemplary embodiment, damage to a core may be prevented in a process of manufacturing the core.

Also, according to the above exemplary embodiment, a turbine blade cooling passage having a complex shape may be easily formed as work accuracy of a core increases.

However, the scope of the inventive concept is not limited by the above effects.

While the inventive concept has been particularly shown and described with reference to the exemplary embodiments thereof, they are provided for the purposes of illustration, and it will be understood by one of ordinary skill in the art that various modifications and equivalent to these embodiments can be made from the inventive concept.

What is claimed is:

1. A core for casting a turbine blade to form at least one cooling passage in a wing portion of the turbine blade, wherein the wing portion comprises a leading edge region and a trailing edge region, and has a streamlined cross-section, the core comprising:

at least one of a first core unit having a shape corresponding to a cooling passage located at the leading edge region, and a second core unit spaced apart from the first core unit and having a shape corresponding to a cooling passage located at the trailing edge region, wherein each of the first core unit and the second core unit comprises:

a plurality of extending portions extending in a longitudinal direction and located substantially parallel to one another;

at least one curved portion connecting adjacent ends of the plurality of extending portions; and at least one through-portion located between the plurality of extending portions and having an empty space extending in a width direction of the wing portion, wherein the at least one through-portion of the first core unit and the at least one through-portion of the second core unit extend in substantially the same direction along the width direction of the wing portion, and wherein the first core unit comprises a plurality of through-portions which extend in a longitudinal direction of the wing portion.

2. The core of claim 1, further comprising:

a third core unit located adjacent to a trailing edge of the second core unit and having a plurality of holes and a plurality of slots; and an additional through-portion located between the second core unit and the third core unit and having an empty space extending in the width direction of the wing portion.

3. The core of claim 2, wherein the third core unit is connected to the trailing edge of the second core unit.

4. The core of claim 1, wherein the plurality of extending portions comprise a first extending portion and a second extending portion located on a leading edge of the first core unit, and wherein the first core unit comprises a plurality of connecting portions configured to connect the first extending portion with the second extending portion.

5. The core of claim 1, wherein the at least one through-portion of the first core unit and the at least one through-portion of the second core unit are substantially parallel to each other.

6. The core of claim 1, wherein at least two of the plurality of through-portions of the first core unit are substantially parallel to each other.

7. The core of claim 1, wherein the second core unit comprises a plurality of through-portions, and at least two of the plurality of through-portions of the second core unit are substantially parallel to each other.

8. The core of claim 1, further comprising:

a third core unit located adjacent to a trailing edge of the second core unit, and having a plurality of holes and a plurality of slots; and an additional through-portion located between the second core unit and the third core unit, and having an empty space extending in the width direction of the wing portion, wherein the additional through-portion is located substantially parallel to the at least one through-portion of the first core unit.

9. The core of claim 1, further comprising:

a third core unit located adjacent to a trailing edge of the second core unit, and having a plurality of holes and a plurality of slots; and an additional through-portion located between the second core unit and the third core unit, and having an empty space extending in the width direction of the wing portion, wherein the additional through-portion is located substantially parallel to the at least one through-portion of the second core unit.

10. The core of claim 1, wherein the plurality of extending portions and the at least one curved portion are connected to one another to form an S-shape.

11. The core of claim 1, wherein edges of the at least one curved portion are chamfered so as to have a curved shape.

12. A method of manufacturing a core for casting a turbine blade to form at least one cooling passage in a wing portion of the turbine blade, wherein the wing portion comprises a leading edge region and a trailing edge region and has a streamlined cross-section, the method comprising:

forming the core of claim 1 by injecting a core forming material into a cavity of a mold; and separating the core from the mold, wherein the separating of the core comprises separating the mold in the width direction of the wing portion.

13. A core for casting a turbine blade to form at least one cooling passage in a wing portion of the turbine blade, wherein the wing portion comprises a leading edge region and a trailing edge region, and has a streamlined cross-section, the core comprising:

at least one of a first core unit having a shape corresponding to a cooling passage located at the leading edge region;

a second core unit spaced apart from the first core unit and having a shape corresponding to a cooling passage located at the trailing edge region; and a third core unit located adjacent to a trailing edge of the second core unit and having a plurality of holes and a plurality of slots, wherein each of the first core unit and the second core unit comprises:

a plurality of extending portions extending in a longitudinal direction and located substantially parallel to one another;

at least one curved portion connecting adjacent ends of the plurality of extending portions, at least one through-portion located between the plurality of extending portions and having an empty space extending in a width direction of the wing portion, wherein the at least one through-portion of the first core unit and the at least one through-portion of the second core unit extend in substantially the same direction along the width direction of the wing portion, wherein the first core unit comprises a plurality of through-portions, wherein a portion of the second core unit and a portion of the third core unit are formed together in a first S-shape curve, and wherein the plurality of extending portions of the first core unit are formed together in a second S-shape curve.

* * * * *